United States Patent [19]

Frearson

[11] Patent Number: 4,648,258

[45] Date of Patent: Mar. 10, 1987

[54] BREAKSTEM FASTENER INSTALLATION TOOL

[75] Inventor: William H. Frearson, Letchworth, England

[73] Assignee: Avdel Limited, Welwyn Garden City, England

[21] Appl. No.: 860,544

[22] Filed: May 7, 1986

[30] Foreign Application Priority Data

May 10, 1985 [GB] United Kingdom ..... 8511945
Nov. 4, 1985 [GB] United Kingdom ..... 8527118

[51] Int. Cl.[4] ..... B21D 9/05

[52] U.S. Cl. ..... 72/391; 72/453.19; 72/453.17; 29/243.53

[58] Field of Search ..... 29/243.53, 243.54, 243.55; 72/391, 453.19, 453.17; 227/2, 4, 8; 173/13; 81/54, 57.11; 51/170 R, 134.5 F

[56] References Cited

U.S. PATENT DOCUMENTS

| | | | |
|---|---|---|---|
| 4,122,904 | 10/1978 | Haytayan | 227/78 |
| 4,211,353 | 7/1980 | Aunis | 173/13 |
| 4,452,387 | 6/1984 | Haytayan | 227/8 |
| 4,515,005 | 5/1985 | Klein | 72/391 |
| 4,549,681 | 10/1985 | Yamamoto et al. | 227/8 |
| 4,598,571 | 7/1986 | Oefinger | 72/453.17 |

*Primary Examiner*—Robert C. Watson
*Attorney, Agent, or Firm*—Oblon, Fisher Spivak, McClelland & Maier

[57] ABSTRACT

A hand-held rivet installation tool is provided with an airflow ejector (23, 26, 28) to eject broken off rivet stems. The tool has a base (71) on which it can stand on a level surface. A valve (73) is provided with its actuating plunger (75) protruding from the base. When the tool is standing on its base, the plunger (75) is pushed in and the valve (73) shuts off the air supply to the ejector. When the tool is picked up again the valve (73) stays in the off position until the tool-actuating trigger (31) is operated again. Thus needless waste of air through the ejector, when the tool is not being used, is eliminated.

6 Claims, 4 Drawing Figures

Figure 1:
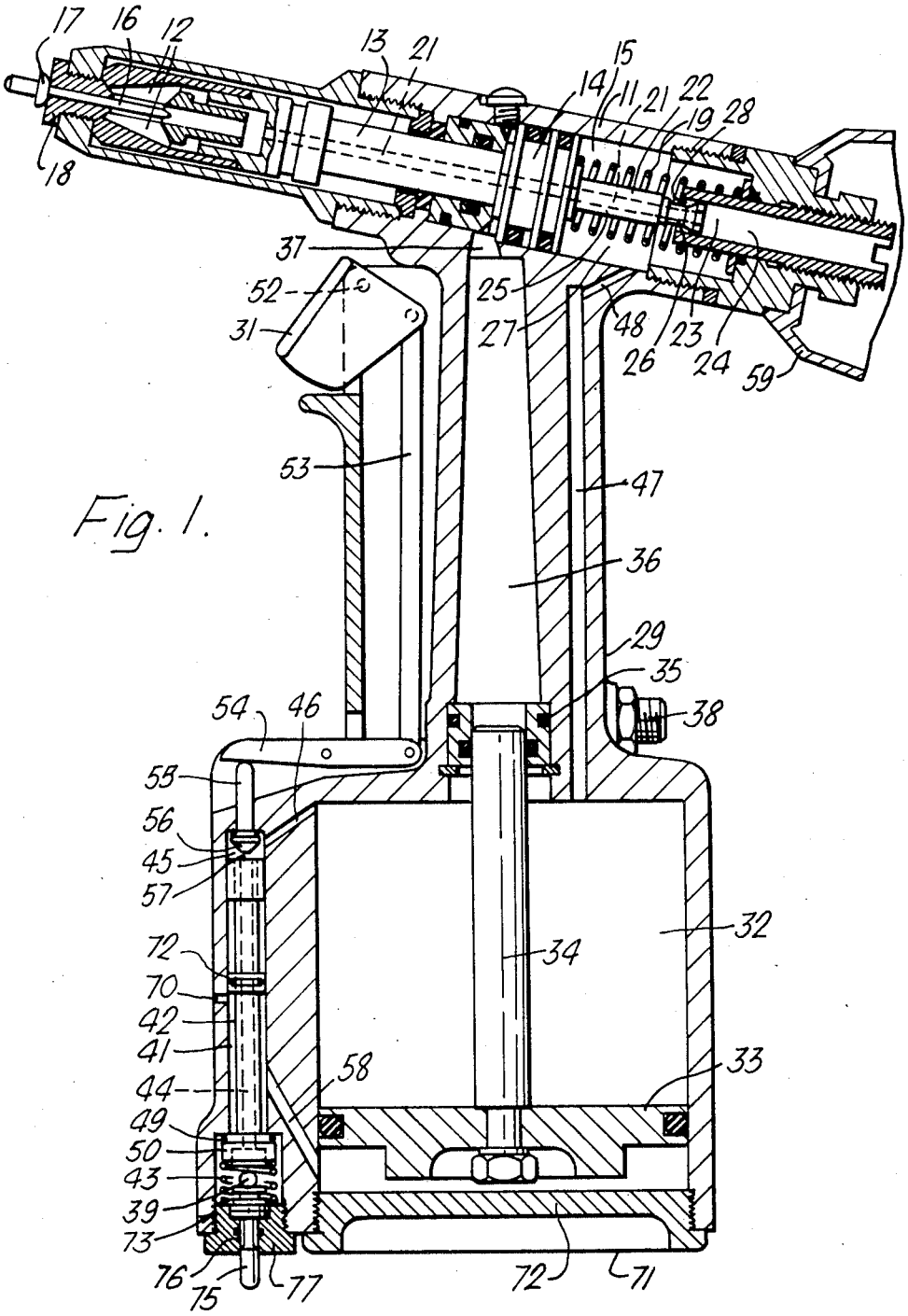

Fig. 2.
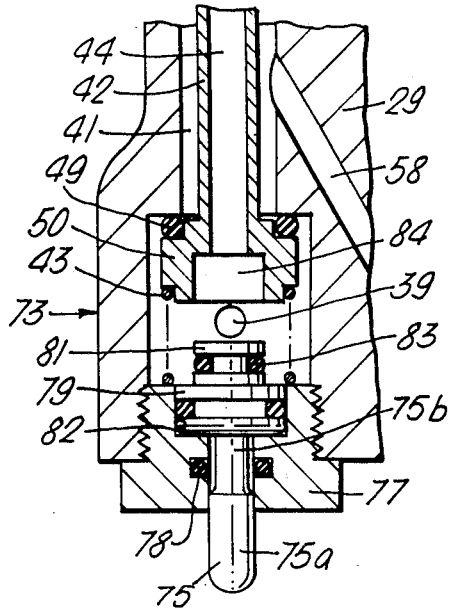
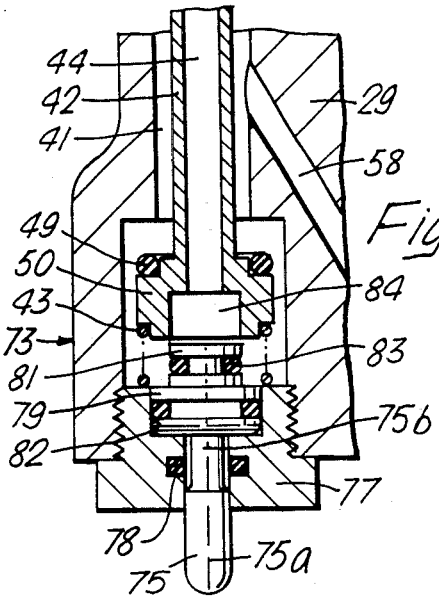
Fig. 3.
Fig. 4.
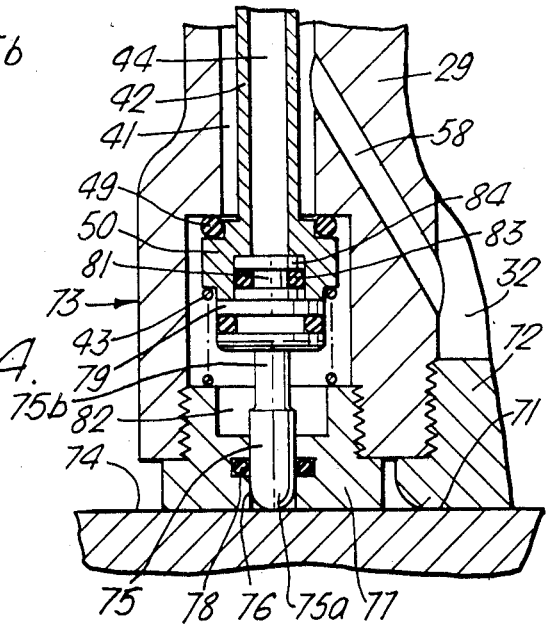

BREAKSTEM FASTENER INSTALLATION TOOL

The invention relates to a breakstem fastener installation tool. Such a tool is used to instal a fastener such as a rivet or a bolt in which a projecting stem is used in the installation process, for example by applying tension or rotational force to the stem, and the projecting part of the stem is thereafter broken off in order to produce an installed fastener having a substantially flush head surface. It is common for such tools to be provided with an airflow ejector e.g. for removing the broken-off portion of the stem from the fastener and from the working part of the installation tool which engages the stem, so that the tool is ready to engage and instal the next fastener. Alternatively or additionally, such an airflow ejector may be used to provide suction to retain a fastener in the nosepiece of the tool prior to installation. Such an airflow ejector is particularly convenient in the case of an installation tool which is powered by compressed air, since a supply of the latter is already provided at the tool, but airflow ejectors can be provided on other types of tools.

Such tools are commonly hand-held, so that an operator may position and align the tool wherever required in order to instal a fastener in a workpiece. However from time to time the operator must release his hold on the tool (e.g. in order to re-position a workpiece). In order to facilitate putting the tool down and picking it up again, it is common for such hand-held tools to be designed so as to stand, when not being held by the operator, in a stable position on a rigid substantially flat and level supporting surface, such as a workbench top, or a workshop floor.

The invention provides a hand-held fastener installation tool including an airflow ejector, which tool is aranged to stand, when not being held by the operator, in a stable position on a supporting surface, the tool including automatic shut-off means, responsive to the proximity of the tool to the supporting surface, for automatically shutting off the supply of air to the ejector when the hand-held tool is standing on the supporting surface.

Preferably the shut-off is arranged to maintain shut-off the air supply to the ejector, after the tool has been removed from the supporting surface, until the tool is actuated to instal a fastener. Preferably the tool includes an air valve which is operated when the tool is actuated to instal a fastener, and re-connection of the air supply to the ejector is actuated by operation of the air valve.

Preferably the tool includes a base for contacting the supporting surface, and the automatic shut-off means includes a member normally projecting from the base and movable, on contact with the supporting surface, to actuate the shut-off means.

Preferably the automatic shut-off means is readily defeatable. Preferably the automatic shut-off means is readily removable from the tool so that a blank member can be substituted for it.

A specific embodiment of the invention will now be described by way of example and with reference to the accompanying drawings, in which:

FIG. 1 is an axial section through a breakstem rivet installation tool incorporating an airflow ejector, and automatic shut-off means therefor; and FIGS. 2, 3 and 4 are enlargements of part of FIG. 1, showing various phases in the operation of the automatic shut-off means.

The tool of this example includes a head housing 11 containing stem-pulling means comprising a set of jaws 12 carried on the front end of a reciprocable draw-rod 13. The draw-rod is reciprocable within the housing, by means of a piston 14 secured to its rear end and sliding within a hydraulic cylinder 15. The draw-rod is urged rearwardly (so that the jaws 12 grip and pull the stem 16 of a breakstem rivet 17 inserted in the nosepiece 18 at the front of the housing) by pumping hydraulic fluid under pressure into the cylinder 15 in front of the piston 14. The draw-bar is returned forwards by a return spring 19 behind the piston 14.

Broken-off rivet stems are removed from the jaws 12 along a passage leading rearwardly from the jaws. The passage is provided by a bore 21 extending rearwardly through the draw-bar 13 and piston 14 and through an extension pipe 22 carried on the rear of the piston 14 and drawbar. The stem removal passage also comprises a bore 23 through a pipe 24 which is mounted at the rear of the housing, adjacent the extension pipe 22 and in axial alignment with it.

The extension pipe 22 comprises two portions, a first portion 25 which provides most of the length of the pipe and is of an external diameter which is a close fit within the bore 23 of the rear pipe 24, and a second, shorter and rearwardly extending part 26 which is of smaller external diameter. When the pipes are in the relative axial positions shown in FIG. 1, the rearwards half of the part 26 is within the forwards end of the bore 23 of the rear pipe 24. By means which be described below, compressed air is fed to the space 27 around the extension pipe 22 (this space 27 is in fact part of the hydraulic cylinder 15 behind the piston 14, into which space hydraulic fluid does not enter). The annular gap 28 between the exterior of extension pipe part 26 and the wall of the bore 23 of the rear pipe 24 provides airflow inlet means to the stem ejector passage comprising the bores 21 and 23 and provides a rearwards airflow along the bore 23 of the rear pipe 24, the exterior of the extension pipe part 26 being shaped to increase this airflow. This tends to suck air rearwardly along the bore 21, which assists both in pulling broken-off stems rearwardly out of the jaws, and in retaining a rivet stem within the tool nosepiece 18 until the jaws 12 close on it and grip it.

The remainder of the tool essentially comprises a pneumatic/hydraulic intensifier system for providing hydraulic fluid under pressure to drive the head piston 14. Integral with the head housing 11 is an intensifier housing 29 substantially at right angles, the two housings being provided as part of a single casting. The housing 29 forms a handle by which the tool may be held in an operator's hand, and carries on its exterior a trigger 31 for actuating the tool. The intensifier comprises a pneumatic cylinder 32 in which slides a double-acting pneumatic piston 33. The piston 33 is secured to a hydraulic plunger rod 34 which extends through a seal 35 into a hydraulic chamber 36, which communicates via a bore 37 with the hydraulic head cylinder 15 in front of the head piston 14, the chamber 36, bore 37 and space 15 in front of the head piston being full of hydraulic fluid.

The intensifier housing 29 carries a compressed airline connector 38 by means of which compressed air is supplied to an inlet port 39 at the bottom end of an elongated valve chamber 41 which carries a reciprocable valve spool 42. The valve spool is urged by means of a spring 43 into an upper position, shown in FIGS. 1 and 2. When the valve spool is in this position compressed air passes up through a bore 44 along the centre of the spool, into the space 45 at the top of the valve chamber 41, and through an inclined bore 46 into the top of air cylinder 32. Also from the top of air cylinder 32 another bore 47 and 48 connects to the space 27 around the extension pipe 25, to provide the ejector compressed air feed referred to above. The pressure of air above the piston 33, and the urging of return spring 19, keep the air piston 33 at the bottom of its stroke and the head piston 14 in its forward position. When the valve spool 42 is in its uppermost position, as illustrated in FIG. 1, under the urging of spring 43, a seal 49 around the lower enlarged end 50 of the spool seats against a shoulder 51 on the valve chamber, to prevent compressed air passing up the valve chamber around the outside of the valve spool.

Trigger 31 can rock about a pivot 52 and is connected by a link 53 to one end of a rocking lever 54. The other end of the rocking lever 54 rests on the upper end of plunger 55 which protrudes through the tool housing, the lower end of the plunger carrying a conical face 56, which, when pushed into contact with the upper end 57 of the bore 44 through the valve spool 42, seals it off and stops compressed air emerging from the bore.

In this example tool a base is provided by the annular underface 71 of the bottom end plug 72 of the pneumatic cylinder 32. On this base the tool can stand in a stable position on a suitable surface such as a workbench top or a workshop floor. The tool is provided with automatic shut-off means 73, which will be described in detail later, for automatically shutting off the supply of air to the ejector, when the tool is standing with its base in contact with the support surface, as is illustrated in FIG. 4.

The normal or un-actuated condition of the tool is as shown in FIGS. 1 and 2, with the tool not standing on the support surface.

When the operator then presses trigger 31, the plunger 55 is pushed downwards. As soon as the conical face 56 seats on the upper end 57 of the spool, the supply of air to the top of the air cylinder 32, and to the ejector, is shut off. As the plunger 55 continues to descend, it pushes down the valve spool 42, and the seal 49 unseats from shoulder 51, as shown in FIG. 3. This allows compressed air to pass up into the valve chamber around the outside of the valve spool. This compressed air passes by means of an inclined bore 58, to the bottom of the cylinder 32, below the air piston 33. This forces the air piston 33 upwards, there being no compressed air from the inlet applied to the space above it, and the air already in that space escaping through bores 47, 48 and the ejector. The rising air piston 33 pushes hydraulic plunger rod 34 up into the hydraulic chamber 36. The displacement of hydraulic fluid forces the head piston 14 rearwardly. The jaws 12 grip the rivet stem 16 and pull it, thereby installing the rivet 17. As the head piston 14 retracts, the larger diameter portion 25 of the extension pipe 22 enters the front end of the bore 23 of rear pipe 24, thus shutting off the ejector, although at this stage no air is being fed to the ejector. The tension exerted on the rivet stem increases to the point at which the stem breaks, at a position flush with or inside the installed rivet, the broken-off part of the stem being retained between the jaws. The operator releases the trigger 31, and the valve spool 42 and plunger 55 return to their upper positions, under the urging of spring 43. Supply of compressed air is shut off from below air piston 33 because O-ring seal 49 reseats on shoulder 51. Compressed air supply is re-connected to above air piston 33, and to the ejector, because conical face 56 of plunger 55 is unseated from the upper end 57 of the spool 42 by the air pressure in the bore 44. The pressure on the hydraulic fluid in chamber 36 is released, and head piston 14 moves forwards again under the urging of spring 19.

A main exhaust port 70, half way up the valve chamber 41, connects the valve chamber to outside atmosphere. A land and seal 72 on the valve spool 42 move from one side to the other of the exhaust port 70, during movement of the valve spool between its two positions, to co-operate with the exhaust port 70 in venting to atmosphere that part of the air cylinder 32, on one or other side of piston 33, which is unpressurised.

When the larger diameter portion 25 of extension pipe 22 leaves the front end of bore 23 of rear pipe 24, the ejector comes into action again, since air is already being supplied to it. When the draw rod reaches its forwards position, the jaws 12 open slightly due to contact with the rear of the nosepiece 18, and release their grip on the broken-off stem. The broken-off stem is then sucked rearwardly along the passage provided by bores 21 and 23, due to the air-flow of the ejector, and pushed out of the tool, where there may be provided a container such as 59 to catch and retain it. The tool is then ready for the stem of a further rivet to be inserted in the nosepiece, to be installed by the tool.

As mentioned previously, the action of the ejector when it is running causes some airflow rearwardly along the bore 21, which assists in retaining a rivet in the nosepiece until the jaws have gripped it, which occurs only after the trigger 31 is pressed. If the tool is to be used in a position with the nosepiece pointing downwards, so that the rivet tends to drop out of the nosepiece, clearly the use of the ejector to retain the rivet is a great advantage. However, the ejector when running uses up compressed air and is also noisy.

The hand-held tool of this example is provided with means 73 for automatically shutting off the air supply to the ejector when the tool is temporarily not being used and standing with its base 71 supported on a support surface 74, as shown in FIG. 4. As illustrated in FIG. 1, the automatic shut-off means 73 is provided by a valve located at the bottom end of the main valve chamber 41, and includes a member in the form of a plunger 75 which protrudes through a bore 76 in an end plug 77. The construction and operation of the automatic shut-off valve 73 is illustrated more clearly in enlarged FIGS. 2, 3 and 4.

Since the plunger 75 protrudes from the bore of the tool, it is of steel (for mechanical strength). Secured to the top of the plunger 75 is a nylon valve member, comprising a lower larger cylindrical part 79, and an upper smaller cylindrical part 81. The larger part 79 carries a periphal O-ring seal 50 and is a sealing sliding fit in a recess 82 in the top of end of plug 77. The smaller upper part 81 carries a peripheral O-ring seal 83, which can enter and seal a recess 84 in the lower enlarged end 50 of the main valve spool 42. The uppermost half **75*b* of the plunger is of reduced diameter compared with the lowermost half 75*a*, which latter can protrude from the bottom of the plug 77, and is a sealing fit in an O-ring seal 78 in the bore 76**.

When the tool is in the normal position, as illustrated in FIGS. 1 and 2, i.e. held in the operator's hand and not standing on its base, and with the trigger not pressed, the automatic shut-off does not come into operation, and the action of the tool is as previously described.

When the operator wishes to temporarily stop using the tool, and stands it by its base 71 on a support surface 74 (FIG. 4), the automatic shut-off valve 73 senses the proximity of the tool to the surface by means of the bottom end of the protruding plunger 75 contacting the surface. As the tool base 71 is lowered towards and in to contact with the support surface 74, the plunger is pushed upwards by the support surface until the upper smaller cylindrical part 79 of its valve member enters the recess 84 in the enlarged lower end 50 of the main valve spool 42. The O-ring 83 around the part 79 seals with the wall of the recess 84, and seals the lower end of the bore 44 which runs along the centre of the valve spool 42, as illustrated in FIG. 4. This shuts off the supply of compressed air, through the space in the pneumatic cylinder 32 above the piston 33, to the ejector 24, 26 and 28. Hence wastage of compressed air, and the noise produced by the air passing through the ejector, while the tool is temporarily not being used, is eliminated. The full-diameter part 75*a* of the plunger 75 is in contact with the O-ring seal 78 in the bore 76, thus preventing leakage of compressed air around the plunger 75.

When the operator picks up the tool again, the air supply to the ejector is not turned on again until the operator presses the trigger 31 to actuate placing of a fastener. This is because the resultant thrust of the compressed air on the shut-off valve member keeps the valve member pressed upwardly, to seal the lower end of valve spool bore 44, even after the support surface 74 is no longer in contact with the bottom end of plunger 75. This is because the plunger 75 is smaller in diameter, and therefore also in cross-sectional area, than the smaller upper part 81 of the shut-off valve member. When the operator next presses the trigger 31 to place a further fastener, the descending main valve spool 42 pushes the valve body 79, 81 downwardly until the larger part 79 enters the recess 82 in the top of the end plug 77 and the O-ring 80 seals against the wall of the recess 82. The thrust of the compressed air on the upper annular surface of the larger valve part 79 then forces the plunger and valve downwardly, to the position illustrated in FIG. 3, and retains them there. The air in the recess 82 below the O-ring 80 escapes around the narrow part 75*b* of the stem 75 which is opposite the O-ring 78 in bore 76.

Thus, in the tool described in the foregoing example, the ejector is shut-off when the tool is set down on a support surface, and is not re-established until the tool has been picked up again and the trigger pressed for the next use of the tool. This provides for the maximum reduction of wastage of compressed air and generation of unwanted noise.

When the ejector is running, the operator may temporarily manually turn it off by applying light pressure on the trigger 31, so as to hold conical face 56 of plunger 55 in contact with the upper end of the bore 44 in spool 42, against the emerging air flow, whilst not depressing the spool 42.

The automatic shut-off valve may easily be removed from the tool by unscrewing the plug 77, enabling easy replacement by a new valve. Alternatively its action can be defeated by substituting a plain plug to provide a tool without the auto shut-off feature, thereby giving continuous suction retention of a rivet in the tool nose piece 18 if desired.

The invention is not restricted to the details of the foregoing example. For instance, the valve member 79, 83 may be made of steel, or other suitable metal, in one piece with the plunger 75.

I claim:

1. A hand held fastener installation tool including an airflow ejector, which tool is arranged to stand, when not being held by the operator, in a stable position on a supporting surface, the tool including automatic shut-off means, responsive to the proximity of the tool to the supporting surface, for automatically shutting off the supply of air to the ejector when the hand-held tool is standing on the supporting surface.

2. A tool as claimed in claim 1, in which the shut-off means is arranged to maintain shut-off of the air supply to the ejector, after the tool has been removed from the supporting surface, until the tool is actuated to instal a fastener.

3. A tool as claimed in claim 2, including an air valve which is operated when the tool is actuated to instal a fastener, and in which re-connection of the air supply to the ejector is actuated by operation of the air valve.

4. A tool as claimed in claim 1, which tool includes a base for contacting the supporting surface, and in which the automatic shut-off means includes a member normally projecting from the base and movable, on contact with the supporting surface, to actuate the shut-off means.

5. A tool as claimed in claim 1, in which the automatic shut-off means is readily defeatable.

6. A tool as claimed in claim 5, in which the automatic shut-off means is readily removable from the tool so that a blank member can be substituted for it.

* * * * *